US007510157B2

(12) United States Patent
Oliver

(10) Patent No.: US 7,510,157 B2
(45) Date of Patent: Mar. 31, 2009

(54) SELF-LEVELING LUGGAGE HANDLE CUP HOLDER

(75) Inventor: Eric A. Oliver, 700 Robey La., Odenton, MD (US) 21113

(73) Assignee: Eric A. Oliver, Odenton, MD (US)

( * ) Notice: Subject to any disclaimer, the term of this patent is extended or adjusted under 35 U.S.C. 154(b) by 519 days.

(21) Appl. No.: 11/558,895

(22) Filed: Nov. 11, 2006

(65) Prior Publication Data

US 2008/0116342 A1 May 22, 2008

(51) Int. Cl.
*A47K 1/08* (2006.01)

(52) U.S. Cl. ..... 248/311.2; 224/400; 224/409; 220/739

(58) Field of Classification Search ..... 248/311.2, 248/689, 202.1, 205.2, 214, 309.1, 314, 316.8; 224/400, 274, 409, 411, 421, 437, 572; 190/102, 190/115; D7/601, 602, 619.1, 620, 709; 220/738, 739

See application file for complete search history.

(56) References Cited

U.S. PATENT DOCUMENTS

| | | | | |
|---|---|---|---|---|
| 2,995,333 | A | 8/1961 | Pazzano | |
| 3,269,683 | A | 8/1966 | Shinaver | |
| 3,734,439 | A | 5/1973 | Wintz | |
| 4,802,602 | A * | 2/1989 | Evans et al. | 220/739 |
| 4,844,399 | A | 7/1989 | Harm | |
| 4,865,240 | A | 9/1989 | Moreschi | |
| 5,190,257 | A | 3/1993 | Gradei et al. | |
| 5,265,834 | A * | 11/1993 | Daniels | 248/104 |
| 5,320,263 | A | 6/1994 | Kobylack | |
| 5,325,991 | A * | 7/1994 | Williams | 220/739 |
| 5,454,484 | A * | 10/1995 | Chelossi | 220/738 |
| 5,622,346 | A * | 4/1997 | Story, Jr. | 248/311.2 |
| 5,704,671 | A | 1/1998 | van der Wal et al. | |
| 5,746,372 | A * | 5/1998 | Spence | 220/738 |
| 5,855,307 | A * | 1/1999 | Biddick et al. | 224/267 |
| 5,857,601 | A | 1/1999 | Greenwood | |
| 6,004,033 | A * | 12/1999 | Cirone | 224/901.8 |
| 6,286,798 | B1 | 9/2001 | Chun | |
| 6,349,846 | B1 * | 2/2002 | Meza | 220/739 |
| 6,390,431 | B1 | 5/2002 | Ott | |
| 6,401,993 | B1 * | 6/2002 | Andrino | 224/148.5 |
| 6,766,930 | B2 * | 7/2004 | Dixon et al. | 224/409 |
| 2006/0037825 | A1 | 2/2006 | Dayton et al. | |
| 2006/0219745 | A1 * | 10/2006 | Riley | 224/400 |
| 2006/0243768 | A1 * | 11/2006 | Dowell | 224/400 |

* cited by examiner

*Primary Examiner*—Anita M King
(74) *Attorney, Agent, or Firm*—The Marbury Law Group, PLLC

(57) ABSTRACT

A cup holder is mountable onto the top of an extendable handle projecting from the top of a piece of wheeled luggage. The cup holder holds a cup of liquid while the luggage is being pulled around. The cup holder is constructed from a stretchy fabric with a handle sleeve that resiliently grips the top of the extended luggage handle. The flexibility of the fabric material provides the cup support, in the form of a truncated hollow cone, with a way of rotating freely with respect to the luggage handle so that a self-leveling action is provided without need of a mechanical hinge.

16 Claims, 13 Drawing Sheets

SELF-LEVELING LUGGAGE HANDLE CUP HOLDER

FIELD OF THE INVENTION

The present invention pertains to the art of cup holders. More specifically, it pertains to a cup holder that can be fastened onto an extendible luggage handle and is flexible so as to maintain the cup being held in upright orientation to prevent spilling.

BACKGROUND INFORMATION

Devices for holding beverage cups have become popular in recent decades and can be found mounted in cars, on golf carts, and on furniture. Many cup holder designs have been implemented.

As an example, a self-leveling cup holder has been proposed, which has a rigid structure for receiving a beverage container and which clamps to a golf cart handle. The cup holder uses a mechanical swivel structure to maintain the beverage in a nominally level state when the golf cart handle is moved. For further details, refer to U.S. Pat. No. 3,269,683 to Shinaver.

A self-leveling cup holder that fastens to a rolling luggage case would be useful. Although a cup holder like that disclosed by Shinaver may be well adapted to use on a golf cart, it is ill suited to use on a rolling luggage where it would need to be readily removable from the handle (since the handles on rolling luggage tend to be retractable), yet provide secure support when installed. A cup holder than can be easily attached and removed from the handle of a piece of wheeled luggage has been proposed. Although one embodiment discloses a pivot means, it does not appear to be self-leveling. For further details, refer to U.S. Pat. No. 6,390,431 to Ott.

A cup holder has been proposed that is self-leveling via a mechanical pivot and can be affixed to wheeled luggage. For further details, refer to U.S. Patent Application Publication No. 2006/0037825 by Dayton et al. The various embodiments of the Dayton et al. cup holder are either integrated into the collapsible handle or into the frame of the luggage. Such integration would require substantial structural accommodations (drilling of holes, assembly concurrent with manufacture of the luggage, etc.) and does not appear to be suitable for retrofitting to existing luggage without substantial effort.

In the context of modern travel and business, what is needed is a self-leveling cup holder that can be removably affixed to a piece of wheeled luggage in a way that both the fixing and the removal can be accomplished quickly and easily and can be easily stored when not in use. This will avoid any need for substantial modification of existing luggage designs and will avoid the hassle and time expense of installation and removal that are non trivial.

SUMMARY OF THE INVENTION

The present invention provides a way to support a beverage container that avoids the problems described above. The present invention may be comprised as a self-leveling cup holder that can be removably affixed to a piece of wheeled luggage in a way that both the fixing and the removal can be accomplished quickly and easily.

According to embodiments of the present invention a cup holder is provided. One part of the cup holder is a truncated hollow cone sized to hold a typical beverage cup. Another part of the cup holder is a handle sleeve sized to fit over and resiliently hug the top of an extended handle of the sort typically found on rolling luggage. When in use, the cup holder is mounted onto the top of the extended handle of a piece of rolling luggage and holds a cup of liquid while the luggage is being pulled around. The cup holder is constructed from a stretchy fabric so that the handle sleeve resiliently grips the top of the luggage handle. The flexibility of the fabric material provides the flexibility for the truncated hollow cone portion that supports the cup is free to move relative to the luggage handle so that a self-leveling action is provided without need of a mechanical hinge.

One aspect of the present invention is the combination of a flexible structure that fits over and resiliently hugs the top of an extended luggage handle.

Another aspect of the present invention is structure that supports a cup and is free to rotate relative to a supporting member so as to effect a self-leveling action without need of a mechanical pivot structure.

DETAILED DESCRIPTION

The present invention provides a way to carry a beverage cup supported on the collapsible handle of a wheeled piece of luggage. This serves as a convenience for travelers and business people who may wish to carry around a drink while at the same time keep their hands free to do other tasks. Cup holders embodied according to the present invention are formed of flexible materials that permit them to be flattened and stowed inside a coat pocket or an exterior luggage pocket. The fabric-backed polymer foam sheeting (usually formed from polychloroprene) commonly referred to as "neoprene" has been successfully implemented as a suitable material for making the cup holders. Neoprene has the extra advantage of providing an added degree of insulation to help maintain hot or cold temperature of the beverage being carried. Another advantage of using neoprene to form the cup holder is that it may provide a positive grip when in contact with a luggage handle. Neoprene, as intended by this disclosure, includes (without limitation) chloroprene rubber (known in the art as CR and commonly used for manufacture of wet suits), styrene butadiene rubber (known in the art as SBR and commonly used for accessories), and chloroprene/styrene-butadiene blend (known in the art as CS) that is typically 30% CR and 70% SBR.

The cup holders may also be advantageously formed of leather, polymer (e.g., butyl rubber), or any of various textiles such as canvas (e.g., cotton or acrylic), spandex (e.g., Lycra®), nylon (e.g., Cordura®), and microfiber. Various types of paper, including card stock, are considered to be appropriate for embodying the cup holders. Generally, suitable materials include any fabric or flexible material, natural or man-made, that can be sewn, glued, bonded, hemmed, selvedged, piped, cut, imprinted, embroidered, welded (chemically, thermally, or ultrasonically), beaded, melded, bordered, or stamped.

Figure 1:
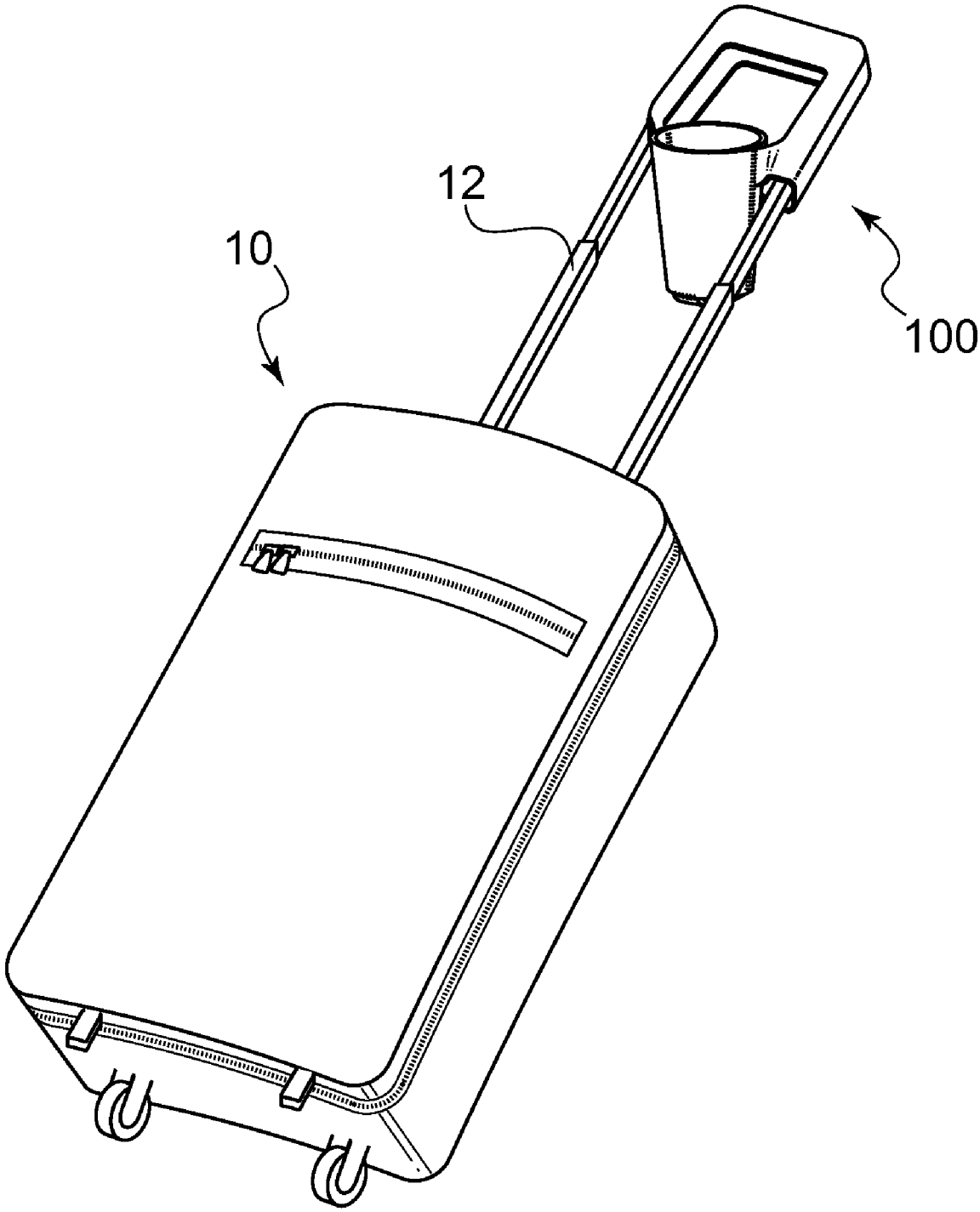
FIG. 1 illustrates a perspective view of a cup holder according to a first embodiment of the present invention being used in combination with wheeled luggage.

A first embodiment of the present invention is illustrated in FIG. 1, which shows a piece of rolling luggage 10 with its handle 12 extended. A cup holder 100 according to the first embodiment of the invention is shown engaged atop the extended handle 12, with the self-leveling aspect being portrayed by the relative angle of the upright cup holder 100 with respect to the tilted handle 12.

Figure 2:
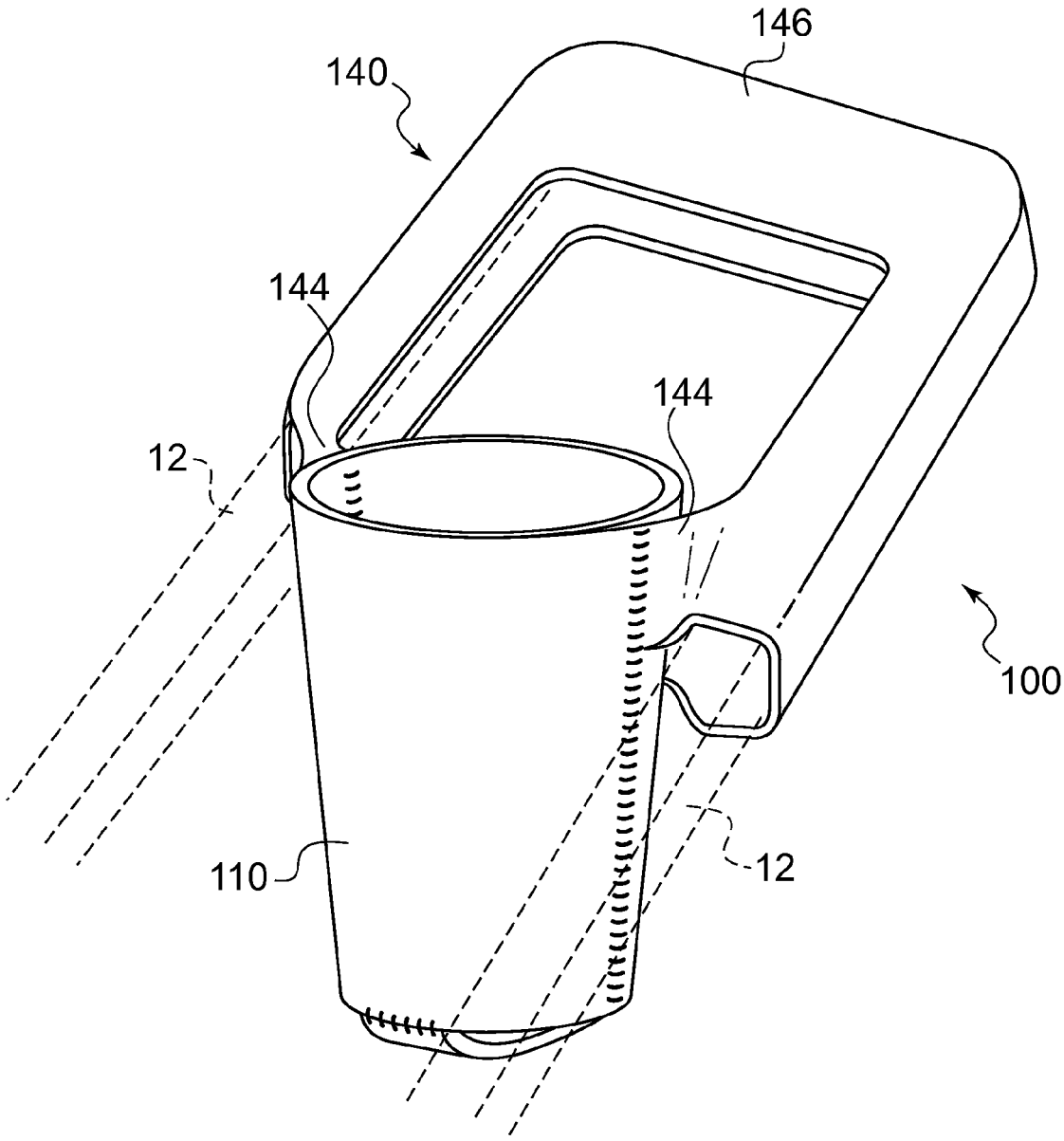
FIG. 2 illustrates a detail view of the cup holder according to the first embodiment, showing relationship of the cup holder to an extendible handle.

The relationship of the cup holder 100 to the top end of the extended handle 12 is illustrated in FIG. 2, with the handle being shown in phantom. A cup support 110 maintains a nominally upright orientation at a relative angle with respect to the tilted handle 12. The cup support 110 has freedom of rotational movement with respect to a handle sleeve 140, which surrounds and resiliently grips onto the upper end of the tilted handle 12.

A pair of opposed sleeve channels 142 wrap around and grip parallel sides of the extended handle 12. The freedom of rotational movement of the cup support 110 relative to the handle sleeve 140 is afforded by twisting of the webbing 144 that extends between opposed sides of the support 110 and the lower ends of the sleeve channels 142. A top channel 146 covers the portion of the hand grip portion of the handle 12 and extends between the two sleeve channels 142, and may be open at the ends to accommodate different sized handles.

Figure 3:
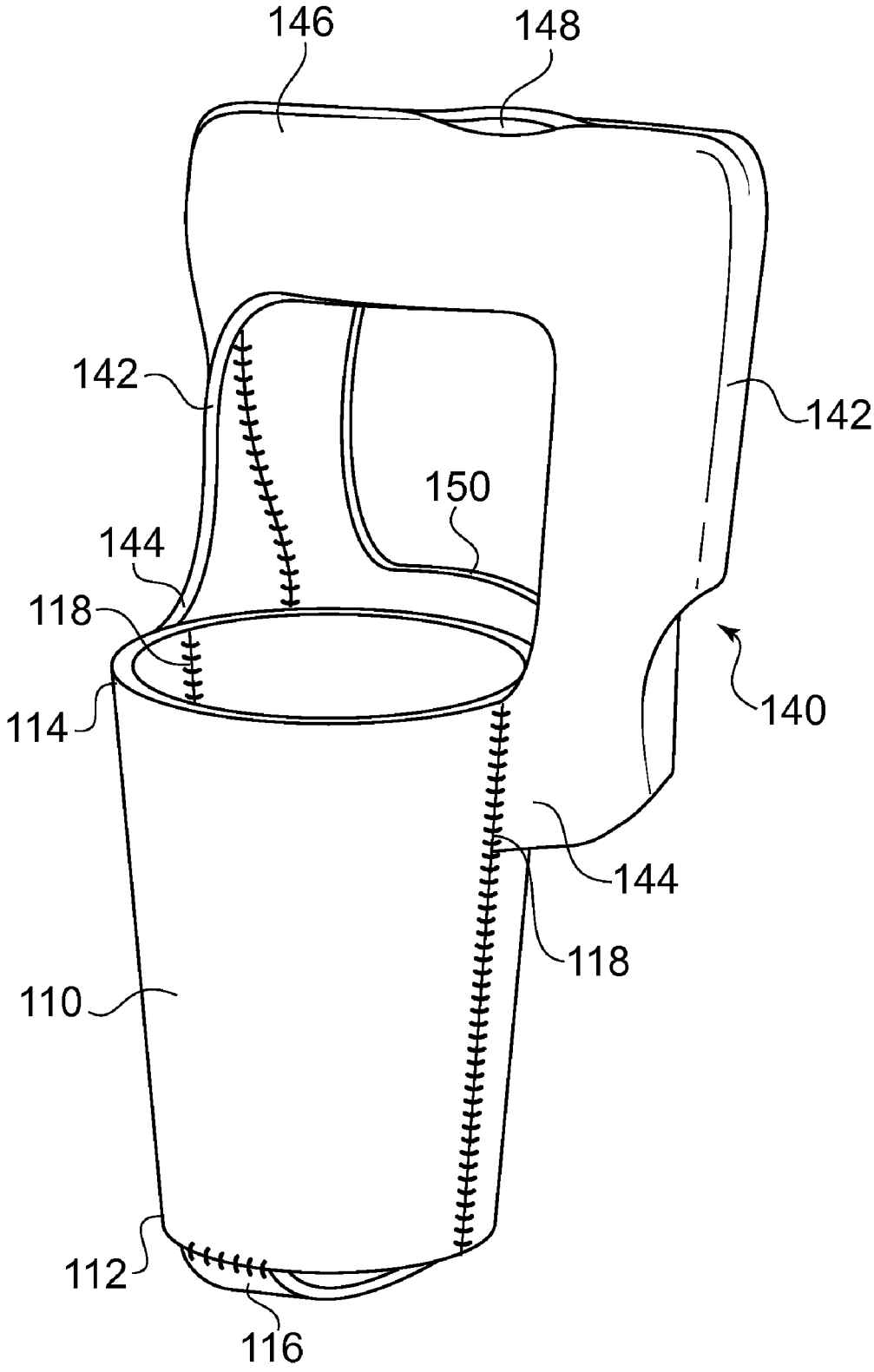
FIG. 3 illustrates a perspective view of a cup holder according to the first embodiment.

As can be seen in FIG. 3, the webbing 144, the sleeve channels 142, and the top channel 146 are formed together as a continuous structure that is connected to opposed sides of the top of the cup support 110. The opposed sleeve channels 142 are also joined together at their bottom ends by a strap 150 which urges the sleeve channels 142 toward one another when the handle sleeve 140 is slipped over an extended luggage handle 12. The webbing 144 attaches to the cup support 110 at seams 118 on opposed sides of the cup support 110. The strap 150 may be alternately embodied to be split with hook and loop fastener elements (e.g., Velcro® brand) to make it adjustable to adjust for different widths of handles 12.

An oblong aperture 148 is formed centered at the midpoint of the top channel 146, at the deepest part of the channel. The aperture 148 is sized to accommodate a lock release push button that is located in the middle of the top of the handle of many (but not all) wheeled luggage cases.

The cup support 110 is shaped as a hollow truncated cone, with the bottom end 112 being slightly narrower than the top end 114. A bottom support strap 116 extends across the bottom of the cup support 110 and is permanently affixed at opposed sides of the cup support 110. The bottom support strap 116 is an optional feature that is useful to prevent small beverage containers from becoming stuck in the cup support 110 with the top of the beverage container not extending above the top end 114 of the cup support 110, or from passing entirely through an open bottom end 112. Alternatively, the cup support 110 may be embodied having a solid bottom rather than a strap, or as a solid bottom with a hole. As shown in FIG. 3, the strap 116 is shown as bowing downward from the bottom of the cup support 110, however, this is not meant as a limitation and the strap 116 may alternatively be fastened so as to bow upward from the bottom edge of the cup support 110.

Although cup support 110 has been illustrated as being solid all the way around, it may be alternately embodied having perforations. According to one alternate embodiment, elongated perforations are formed in the cup support 110 to enable it to roll up easily so the handle 12 can be stowed with the cup holder remaining attached to the handle 12.

Figure 4:
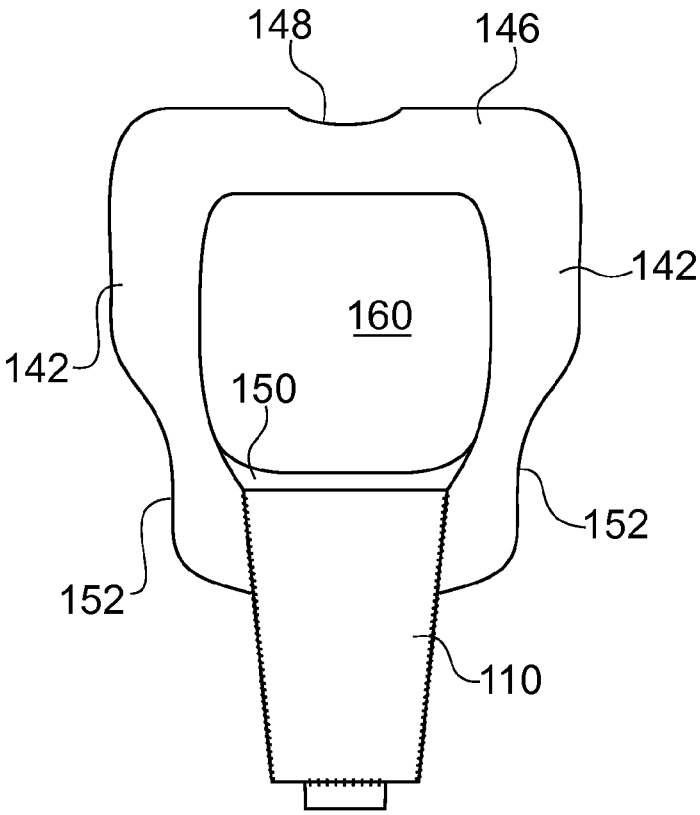
FIG. 4 illustrates a front elevation view of a cup holder according to the first embodiment.

Referring to FIG. 4, a front plan view of the cup holder 100 shows a hand hold opening 160 that is formed by the space between the opposed sleeve channels 142 and between the top channel 146 and the cup support 110 and strap 150. The hand hold opening 160 is sized to accommodate an adult hand fitting therethrough.

Figure 5:
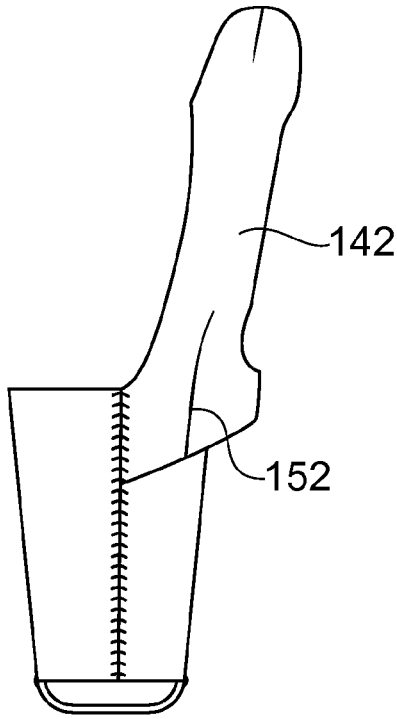
FIG. 5 illustrates a side elevation view of a cup holder according to the first embodiment.

Referring to FIG. 5, gather seams 152 (refer also to FIG. 4) are formed in a lower portion of each of the opposed sleeve channels 142 to narrow the overall width of the bottom end of the handle sleeve 140. The use of the gather seams 152 to narrow the handle sleeve 140 serves to enhance the resilient griping of the handle sleeve onto an extended luggage handle 12, while leaving the remaining, upper portion of the handle sleeve 140 to grip the handle 12 more loosely to keep the cup holder 100 from being too inconvenient during application and removal due to excessive sliding friction forces.

Figure 6:
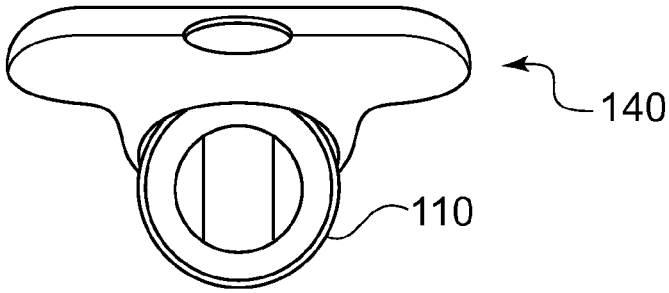
FIG. 6 illustrates a plan view of a cup holder according to the first embodiment.

The rearward offset of the handle sleeve 140 with respect to the cup support 110 is illustrated by the plan view of FIG. 6.

As an optional feature of the first embodiment, the ends of the top channel 146 may be open to allow for oversized handles.

Figure 19:
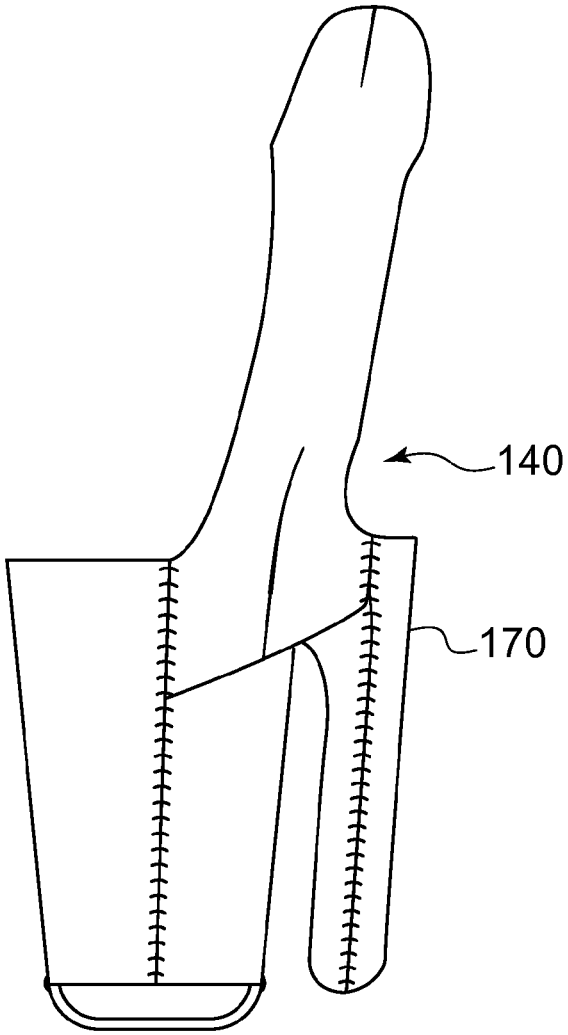
FIG. 19 illustrates a side elevation view of a cup holder with an optional feature of the first embodiment.

Referring to FIG. 19, another optional feature of the first embodiment is a pocket 170 on the handle sleeve 140, on the back side in the illustrated example, which is sized to hold a boarding pass or a paperback book.

Figure 20:
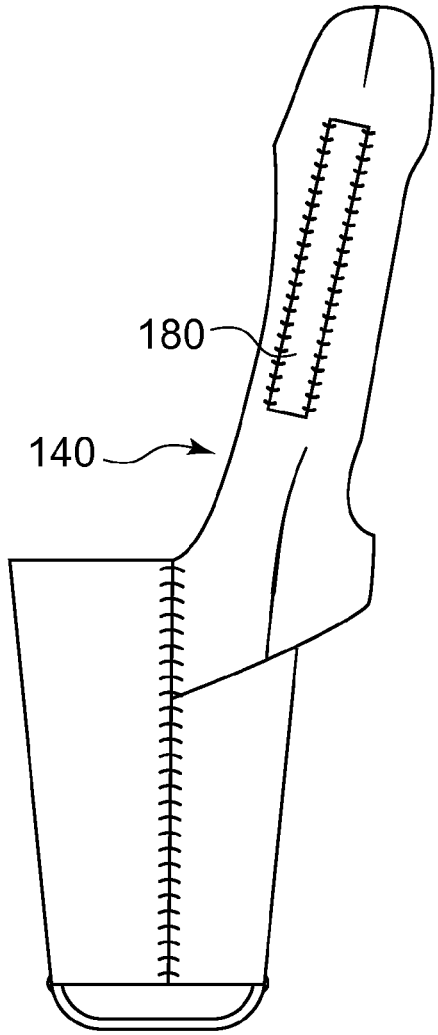
FIG. 20 illustrates a side elevation view of a cup holder with another optional feature of the first embodiment.

Referring to FIG. 20, yet another optional feature of the first embodiment is an elastic pen holder sleeve 180 fixed to a side of the handle sleeve 140. The pen holder sleeve is sized to resiliently grip the shaft of a pen. As an example, a piece of elastic fabric is seamed down two sides to form the resilient pen holder sleeve 180.

A further optional feature of the first embodiment is a hook and loop fastener, one element of which is affixed to the handle sleeve 140, for attaching accessories such as a cell phone holder or a baby bottle holder.

Figure 7:
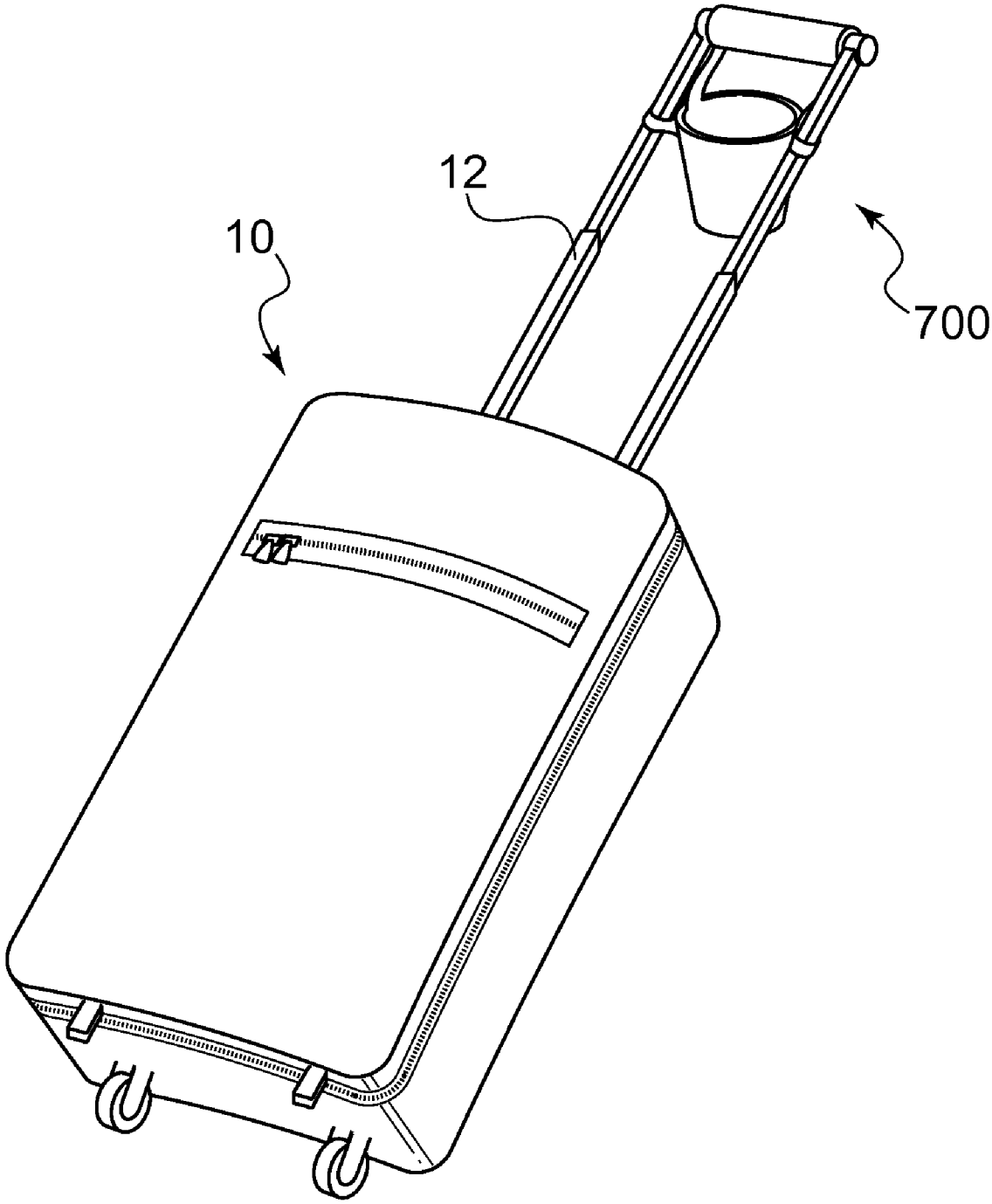
FIG. 7 illustrates a perspective view of a cup holder according to a second embodiment of the present invention being used in combination with wheeled luggage.

A second embodiment of the present invention is illustrated in FIG. 7. A piece of rolling luggage 10 is shown with its handle 12 extended and having a cup holder 700 according to the second embodiment of the invention engaged atop the extended handle 12, with the self-leveling aspect being portrayed by the relative angle of the upright cup holder 700 with respect to the tilted handle 12.

Figure 8:
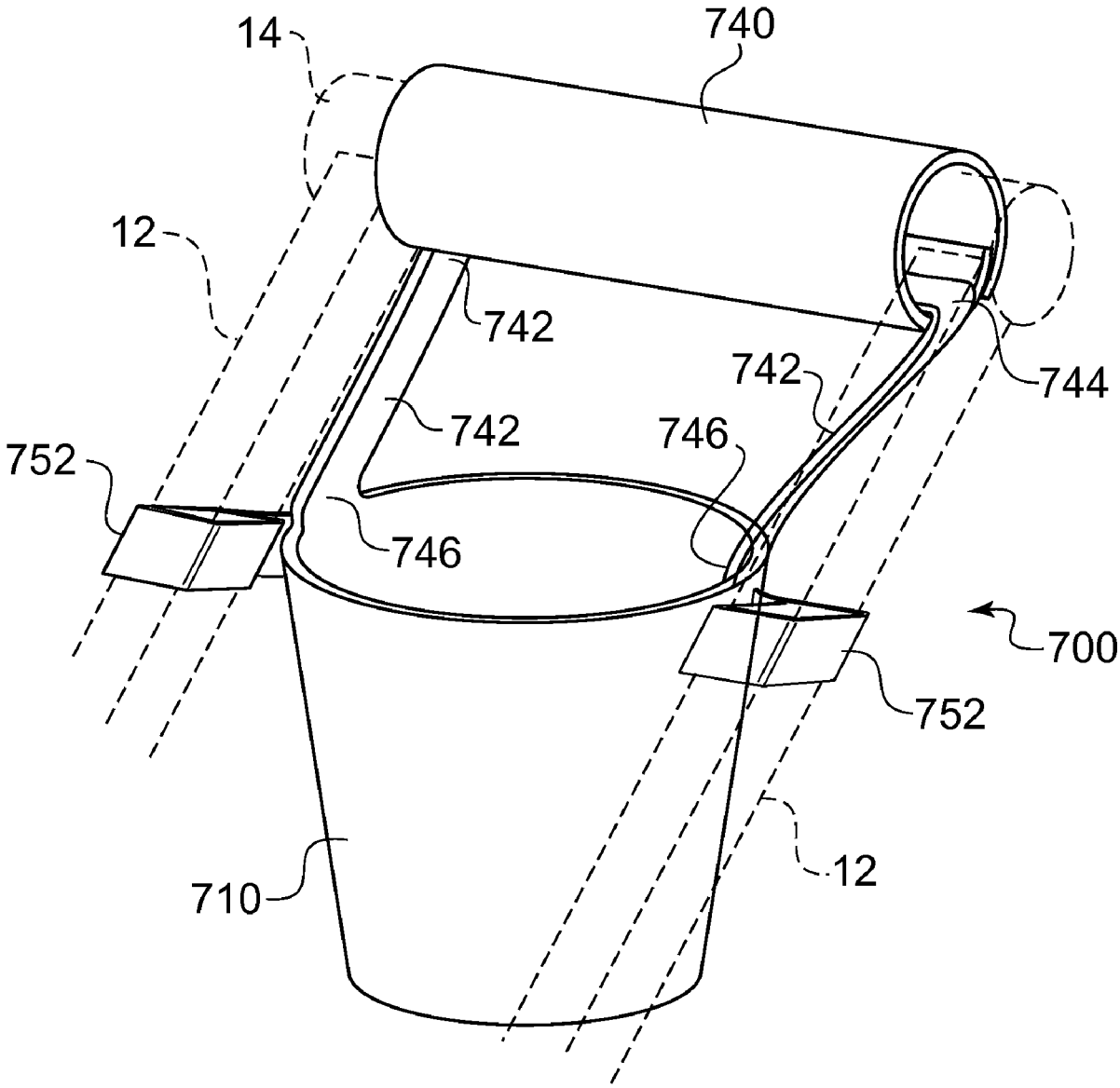
FIG. 8 illustrates a detail view of the cup holder according to the second embodiment, showing relationship of the cup holder to an extendible handle.

The relationship of the cup holder 700 to the top end of the extended handle 12 is illustrated in FIG. 8, with the handle being shown in phantom. A cup support 710 maintains a nominally upright orientation at a relative angle with respect to the tilted handle 12. The cup support 710 has freedom of rotational movement with respect to a handle wrap 740, which surrounds and resiliently grips onto the upper end 14 of the tilted handle 12.

A pair of opposed support straps 742 extend at their upper ends 744 from opposed ends of the handle wrap 740 wrapped around the extended handle's upper end 14, to opposed sides of the upper end of the cup support 710. Swing arresting straps 752, extend outwardly from opposed sides of the cup support 710 and have sufficient length to loop around a member of the handle 12 and fasten the free end to the side of the cup support 710, or to themselves, with a hook loop fastener (refer to FIG. 11). The freedom of rotational movement of the cup support 710 relative to the handle wrap 740 is afforded by twisting of the support straps 742 at the lower ends 746 and twisting of the swing arresting straps 752. This makes the effective pivot axis of the cup holder 700 be adjacent the top edge of the cup support 710.

Figure 9:
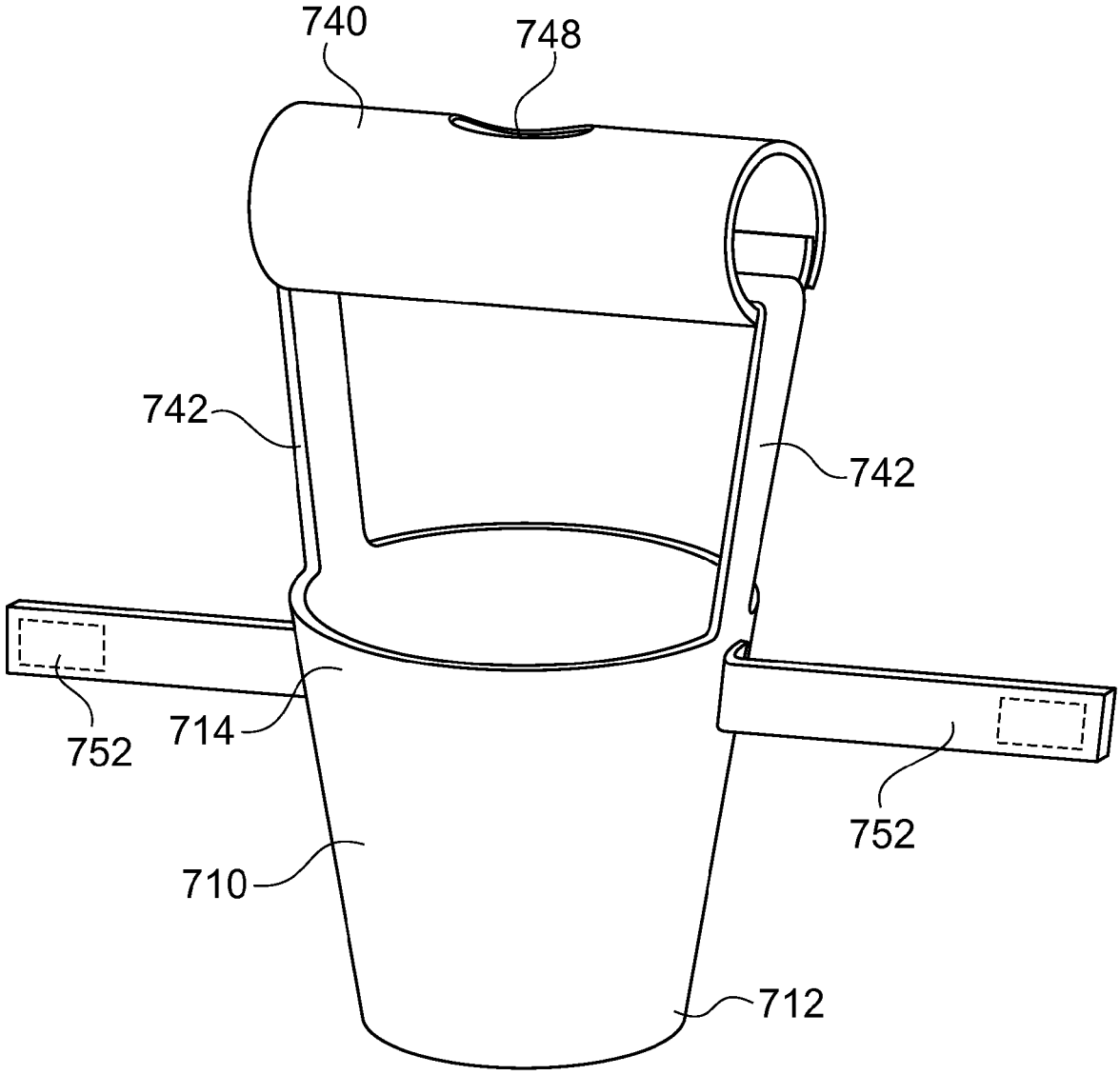
FIG. 9 illustrates a perspective view of a cup holder according to the second embodiment.

As can be seen in FIG. 9, the support straps 742 and the handle wrap 740 are formed together as a continuous structure that is connected to opposed sides of the top of the cup support 710. An oblong aperture 748 is formed centered at the midpoint of the handle wrap 740. The aperture 748 is sized to accommodate a lock release push button that is located in the middle of the top of the handle of many (but not all) wheeled luggage cases.

The cup support 710 is shaped as a hollow truncated cone, with the bottom end 712 being slightly narrower than the top end 714. Although no bottom support strap structure is illustrated as is shown in the first embodiment (refer to FIGS. 2-6), such an optional structure may be usefully implemented with the second embodiment in a manner similar to that shown and described with respect to the first embodiment, or the cup support 710 may have a solid bottom, with or without a hole. The swing arresting straps 752 are shown as extending outwardly from opposed sides of the cup support 710. The swing arresting straps 752 are not required for practice of the invention, but can enhance usefulness of the second embodiment by moderating the degree to which the cup support 710 swings back and forth.

Figure 10:
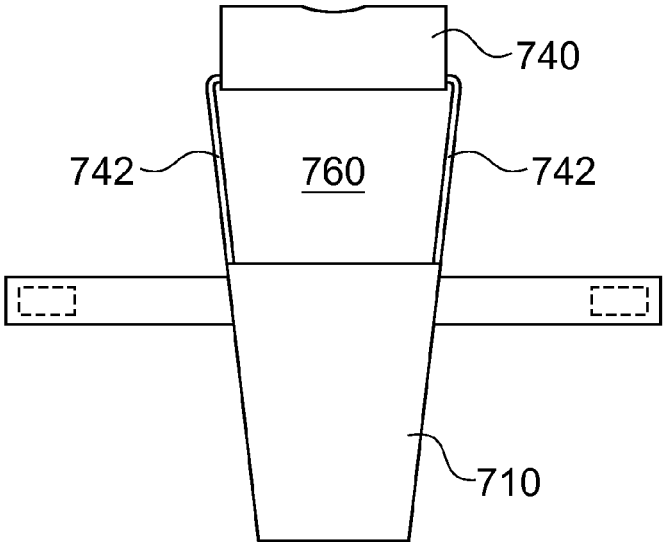
FIG. 10 illustrates a front elevation view of a cup holder according to the second embodiment.

Referring to FIG. 10, a front plan view of the cup holder 700 shows a hand hold opening 760 that is formed by the space between the opposed support straps 742 and between the handle wrap 740 and the cup support 710. The hand hold opening 760 is sized to accommodate an adult hand fitting therethrough.

Figure 11:
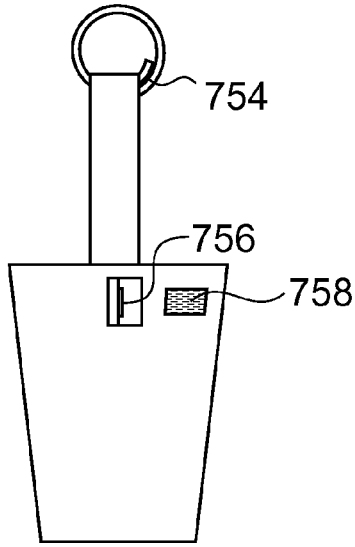
FIG. 11 illustrates a side elevation view of a cup holder according to the second embodiment.

Referring to FIG. 11, a hook and loop fastener 754 for securing the handle wrap 740 is shown. Hook and loop faster elements 756, 758 for the swing arresting straps 752 are illustrated (refer also to FIG. 12), with elements 756 on the ends of the straps 752 and elements 758 on the sides of the cup support 710. The hook and loop fasteners provided by hook and loop elements 756, 758 are used to secure the swing arresting straps 752 in place when looped around members of the extended luggage handle 12. Generally, the fastening elements 754, 756, 758 are not limited to hook and loop type, and any type of soft or hard fastener may be used, including (but without limitation) snaps, buttons, zippers, or hooks.

Figure 12:
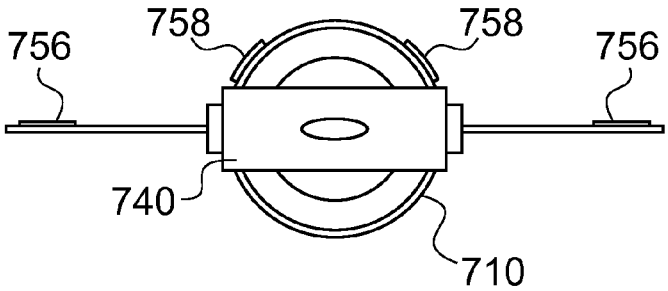
FIG. 12 illustrates a plan view of a cup holder according to the second embodiment.

As shown in FIGS. 11 and 12, fastener elements 758 are shown as being located on the outer surface of the cup support 710. However, this illustrated placement is not meant as a limitations, and fastener elements 758 may alternatively be placed on the strap 752 covering the area starting from the cup support 710 and ending at a point near the other hoot and loop fastener element 756.

As mentioned above, use of the swing arresting straps 752 is not strictly necessary for practice of the invention and may be left to dangle from the side of the cup support 710, or may be omitted entirely from articles manufactured (refer to the third embodiment, described below). The swing arresting straps 752 may be made long so as to permit substantial swing of the cup support 710, or may be made shorter so as to restrain the cup support so that the entirety of its rotational freedom is at the lower ends 746 of the support straps 742.

The alignment of the handle wrap 740 with respect to the cup support 710 is illustrated by the plan view of FIG. 12.

Figure 13:
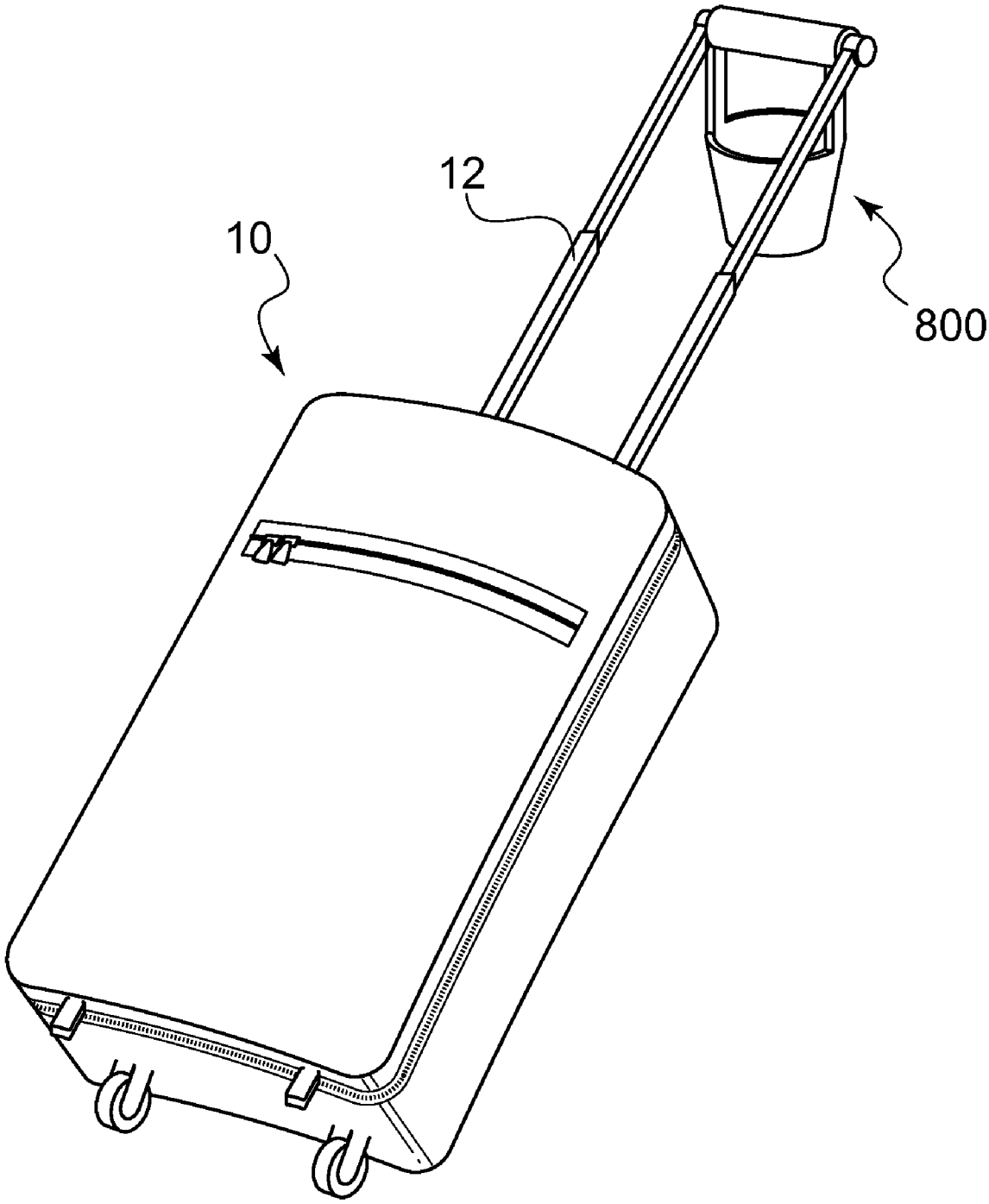
FIG. 13 illustrates a perspective view of a cup holder according to a third embodiment of the present invention being used in combination with wheeled luggage.

A third embodiment of the present invention is illustrated in FIG. 13. A piece of rolling luggage 10 is shown with its handle 12 extended and having a cup holder 800 according to the second embodiment of the invention engaged atop the extended handle 12, with the self-leveling aspect being portrayed by the relative angle of the upright cup holder 800 with respect to the tilted handle 12.

Figure 14:
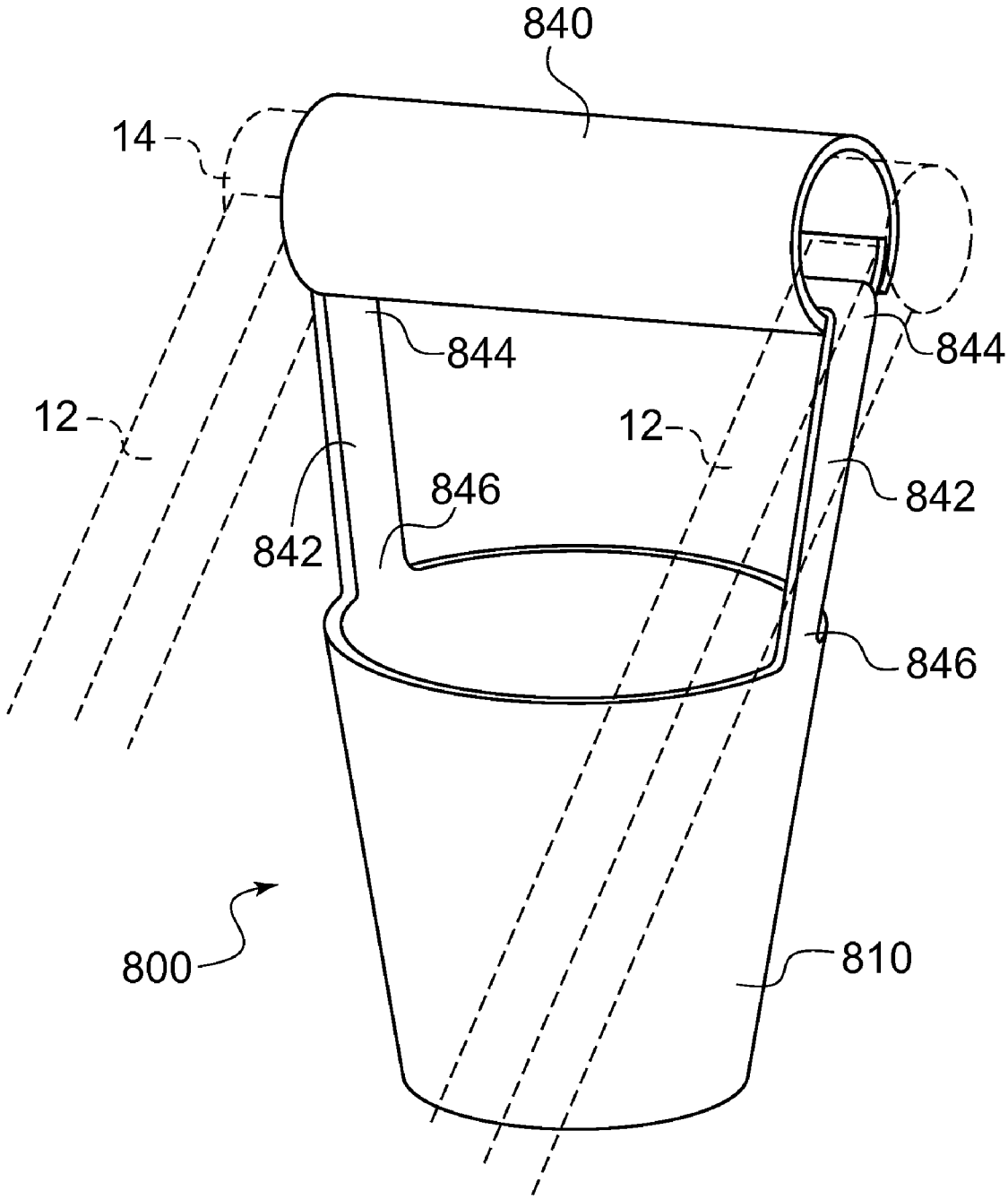
FIG. 14 illustrates a detail view of the cup holder according to the third embodiment, showing relationship of the cup holder to an extendible handle.

The relationship of the cup holder 800 to the top end of the extended handle 12 is illustrated in FIG. 14, with the handle being shown in phantom. A cup support 810 maintains a nominally upright orientation at a relative angle with respect to the tilted handle 12. The cup support 810 has freedom of rotational movement with respect to a handle wrap 840, which surrounds and resiliently grips onto the upper end 14 of the tilted handle 12.

A pair of opposed support straps 842 extend from opposed ends of the handle wrap 840 wrapped around the extended handle's upper end 14, to opposed sides of the upper end of the cup support 810. The freedom of rotational movement of the cup support 810 relative to the handle wrap 840 is afforded by twisting of the support straps 842 at the upper ends 844 and, to a lesser extent, the lower ends 846. This makes the effective pivot axis of the cup holder 800 be adjacent the bottom end of the handle wrap 840, a result primarily of the twisting of the upper ends 844 of the support straps 842.

Figure 15:
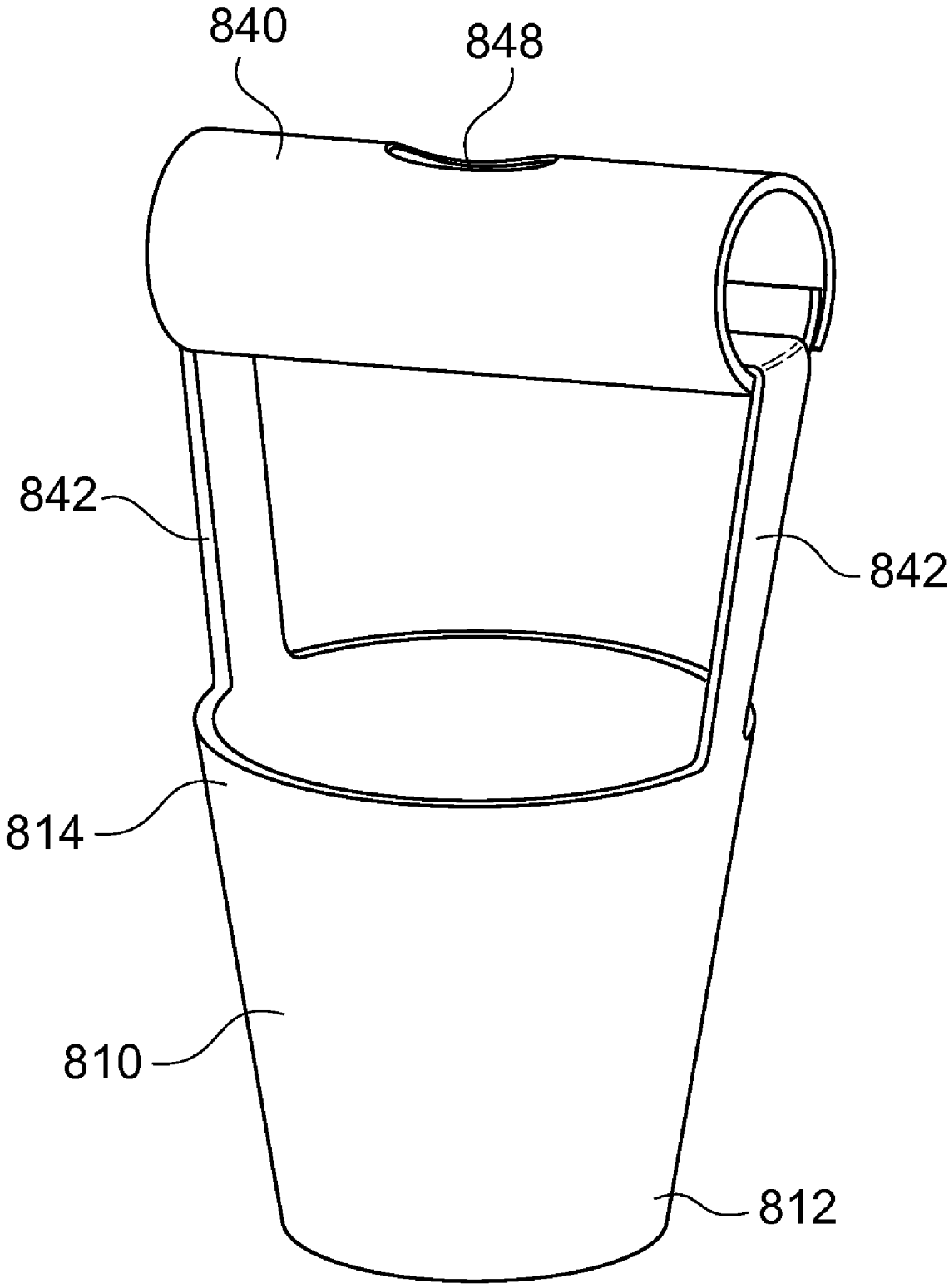
FIG. 15 illustrates a perspective view of a cup holder according to the third embodiment.

As can be seen in FIG. 15, the support straps 842 and the handle wrap 840 are formed together as a continuous structure that is connected to opposed sides of the top of the cup support 810. An oblong aperture 848 is formed centered at the midpoint of the handle wrap 840. The aperture 848 is sized to accommodate a lock release push button that is located in the middle of the top of the handle of many (but not all) wheeled luggage cases.

The cup support 810 is shaped as a hollow truncated cone, with the bottom end 812 being slightly narrower than the top end 814. Although no bottom support strap structure is illustrated as is shown in the first embodiment (refer to FIGS. 2-6), such an optional structure may be usefully implemented with the second embodiment in a manner similar to that shown and described with respect to the first embodiment, or the cup support 810 may have a solid bottom, with or without a hole.

Figure 16:
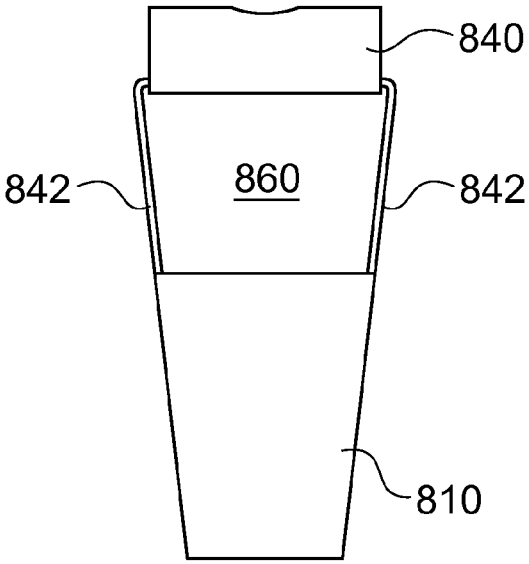
FIG. 16 illustrates a front elevation view of a cup holder according to the third embodiment.

Referring to FIG. 16, a front plan view of the cup holder 800 shows a hand hold opening 860 that is formed by the space between the opposed support straps 842 and between the handle wrap 840 and the cup support 810. The hand hold opening 860 is sized to accommodate an adult hand fitting therethrough.

Figure 17:
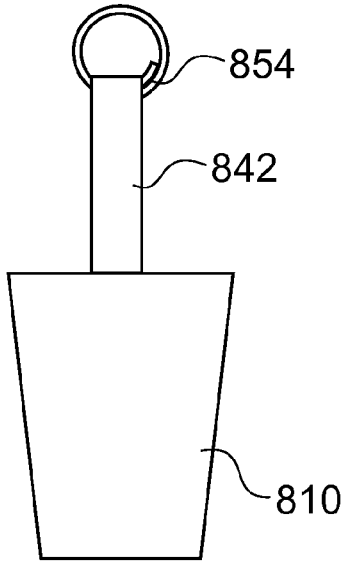
FIG. 17 illustrates a side elevation view of a cup holder according to the third embodiment.

Referring to FIG. 17, a hook and loop fastener 854 for securing the handle wrap 840 is shown. Generally, the fastening element 854 is not limited to hook and loop type, and any type of soft or hard fastener may be used, including (but without limitation) snaps, buttons, zippers, or hooks.

Figure 18:
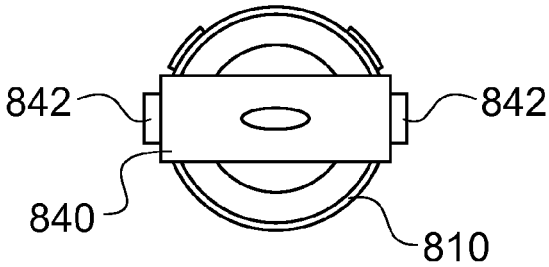
FIG. 18 illustrates a plan view of a cup holder according to the third embodiment.

The alignment of the handle wrap 840 with respect to the cup support 810 is illustrated by the plan view of FIG. 18.

An important advantage of the present invention is that cup holders using this technology are easy to apply to a luggage handle and are also easy to remove. This is a very useful convenience.

The materials used permit natural rotation of the cup support when the luggage is tilted as when it is being moved. This keeps the beverage level as it is affected by the force of gravity. The use of fabric (or leather) flexibility to supplant a mechanical pivot structure has advantages. By eliminating any mechanical pivot from the cup holder, the reliability of the cup holder is improved because there are no moving parts to fail. Eliminating any mechanical pivot from the cup holder also improves the manufacturing cost of the cup holder by reducing inventory requirement of a relatively expensive part.

The all-fabric composition that is possible according to the present invention has the advantage of making the cup holder fully washable via machine laundry. The use of flexible materials to embody the cup holder make it easy to store (i.e., can be stuffed in a pocket when not in use) and lightweight. The lack of any sharp edges points makes the cup holder very safe. By using a stretchy fabric the cup holder can conform to fit a wide variety of sizes and shapes of luggage handles, and can conform to fit a wide variety of sizes and shapes of beverage containers.

The beverage container is protected to some degree from jarring since the flexible material of the cup holder absorbs shock, and the cup support is protected from direct force on either side by the telescoping risers of the luggage handle.

Various embodiments of self-leveling cup holders have been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A self-leveling cup holder for use with an extended luggage handle having a top end, the cup holder comprising:

a hollow cup support sized to receive and support a beverage container; and a means for gripping the top end of the extended luggage handle; and a flexible coupling connecting the means for gripping with the cup support, the flexible coupling being free of a mechanical pivot.

2. The self-leveling cup holder of claim 1, wherein the means for gripping comprises a sleeve sized to fit over and resiliently grip the top end of the extended luggage handle.

3. The self-leveling cup holder of claim 2, wherein the sleeve comprises a pair of opposed sleeve channels joined together by a top channel extending between top ends of the sleeve channels; and wherein the flexible coupling comprises webbing extending between opposed sides of the cup support and bottom ends of the sleeve channels.

4. The self-leveling cup holder of claim 1, wherein the means for gripping comprises a wrap with hook and loop fasteners, the wrap being sized to fit over and secure about the top end of the extended luggage handle via the hook and loop fasteners.

5. The self-leveling cup holder of claim 4, wherein the flexible coupling comprises a pair of support straps extending from opposed ends of the wrap to opposed sides at an upper end of the cup support.

6. The self-leveling cup holder of claim 4, further comprising: swing arresting straps extending outwardly from opposed sides of the cup support.

7. The self-leveling cup holder of claim 1, the cup holder being formed substantially of fabric-backed foam polymer sheeting.

8. The self-leveling cup holder of claim 1, the cup holder being formed substantially of card stock.

9. A self-leveling cup holder for use with an extended luggage handle having a top end, the cup holder comprising:

a hollow cup support sized to receive and support a beverage container; and a sleeve sized to fit over and resiliently grip the top end of the extended luggage handle, the sleeve being pivotably connected to the cup support.

10. The self-leveling cup holder of claim 9, wherein the sleeve comprises a pair of opposed sleeve channels joined together by a top channel extending between top ends of the sleeve channels; and wherein the pivotable connection of the sleeve to the cup support comprises webbing extending between opposed sides of the cup support and bottom ends of the sleeve channels.

11. The self-leveling cup holder of claim 9, the cup holder being formed substantially of fabric-backed foam polymer sheeting.

12. The self-leveling cup holder of claim 9, the cup holder being formed substantially of card stock.

13. A self-leveling cup holder for use with an extended luggage handle, the cup holder comprising:

a hollow cup support sized to receive and support a beverage container;

a sleeve sized to secure to the extended luggage handle; and a flexible coupling connecting the sleeve with the cup support, the flexible coupling being free of a mechanical pivot.

14. The self-leveling cup holder of claim 13, wherein the sleeve comprises a pair of opposed sleeve channels joined together by a top channel extending between top ends of the sleeve channels; and wherein the flexible coupling comprises webbing extending between opposed sides of the cup support and bottom ends of the sleeve channels.

15. The self-leveling cup holder of claim 13, the cup holder being formed substantially of fabric-backed foam polymer sheeting.

16. The self-leveling cup holder of claim 13, the cup holder being formed substantially of card stock.

* * * * *